US006708606B1

(12) United States Patent
Bell, Jr. et al.

(10) Patent No.: US 6,708,606 B1
(45) Date of Patent: Mar. 23, 2004

(54) STRAPPER WITH IMPROVED WINDER

(75) Inventors: Lemuel J. Bell, Jr., Gurnee, IL (US); Timothy B. Pearson, Antioch, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 23 days.

(21) Appl. No.: 10/284,579

(22) Filed: Oct. 31, 2002

(51) Int. Cl.[7] ..... B65B 13/22

(52) U.S. Cl. ..... 100/32; 100/26; 100/29; 242/586.5

(58) Field of Search ..... 100/8, 25, 26, 100/29, 32, 33 PB; 53/589; 242/532.5, 586.1, 586.4, 586.5

(56) References Cited

U.S. PATENT DOCUMENTS

| | | | | |
|---|---|---|---|---|
| 4,605,456 A | | 8/1986 | Annis, Jr. | |
| 5,299,407 A | | 4/1994 | Schuttler et al. | |
| 5,653,095 A | * | 8/1997 | Stamm | 53/592 |
| 6,035,774 A | * | 3/2000 | Fischer | 100/32 |
| 6,463,848 B1 | | 10/2002 | Haberstroh et al. | |
| 6,536,195 B2 | | 3/2003 | Haberstroh et al. | |
| 6,575,086 B2 | * | 6/2003 | Pearson et al. | 100/26 |
| 6,663,040 B2 | * | 12/2003 | Haberstroh et al. | 242/532.5 |

FOREIGN PATENT DOCUMENTS

| | | |
|---|---|---|
| EP | 0870679 B1 | 1/2000 |
| EP | 0847922 B1 | 5/2000 |

* cited by examiner

*Primary Examiner*—Ed Tolan
(74) *Attorney, Agent, or Firm*—Mark W. Croll, Esq.; Donald J. Breh, Esq.; Welsh & Katz, Ltd.

(57) ABSTRACT

A winder for a strapping machine that positions a strap material around a load and tensions the strap material around the load includes a rotating head portion having a stationary element and a pivotal element. The elements each define an outer surface around which the strap material is wound and a slot therebetween for receiving the strap material. The elements each include a gripping portion at about respective ends opposingly facing one another. The pivotal element pivots between an open position in which the gripping portions are spaced from one another and a closed position in which the gripping portions cooperate with one another to engage and secure the strap material. The winder includes a pivot assist assembly to urge the winder to the closed position. A strapping machine and a strapping head are also disclosed.

26 Claims, 5 Drawing Sheets

STRAPPER WITH IMPROVED WINDER

BACKGROUND OF THE INVENTION

The present invention pertains to strapping machines. More particularly, the present invention pertains to an improved winder for a strapping machine that uses the strap tension to secure the strap in the winder.

Strapping machines are in widespread use for applying a strap, such as a plastic strap, in a tensioned loop around a load. A typical strapping machine includes a strap chute for guiding the strap around the load, a strapping head through which the leading end of the strap is fed, and a strap dispenser to dispense a desired length of strap from a coil of strap material.

The strapping head carries out a number of functions. It advances the strap along the chute around the load until the leading end returns to the strapping head and retracts or rewinds the strap from the chute to produce tension in the strap around the load. The strapping head typically includes an assembly for securing the strap in the tensioned loop around the load such as by welding the strap to itself at its overlapping portions.

A typical strapping head includes a pair of advancing rollers for advancing the strap through the strapping head and a pair of retraction rollers for retracting the strap to, for example, take-up the strap. The head also includes a winder or tensioner that rewinds or takes up the strap after it is positioned around the load so as to apply a tension in the strap. In one known configuration, the winder includes a split-type rotating element that has a channel or slot formed therethrough to essentially define split halves of the winder. The split halves are fixed relative to one another and the strap traverses through the slot between the halves. Upon an appropriate signal, the winder is actuated and rotates to tension the strap.

In this arrangement, the strap may not be in tension until it passes over itself around the winder, thus creating sufficient friction to prevent the strap from slipping through the winder slot. It has been observed that often, the winder must rotate in excess of 360 degrees, and with some types of readily compressible loads, it must rotate more than 720 degrees to provide sufficient friction to begin tensioning and to provide the appropriate tension on the strap. This can be problematic where there is a limit to the rewinding length due to structural constraints of the strapping head, winder and drive arrangement or due to load compression constraints (e.g., a not readily compressible load).

In another type of winder, a rotating head is formed having a stationary element and a pivotal element that each define an outer surface around which the strap material is wound. A slot is defined between the elements through which the strap traverses.

The pivotal element is biased toward the stationary element, i.e., to close the slot, by a spring. The biased element must be "pulled" away from the stationary element in order to open the strap slot so that the strap can readily traverse through the slot. The pulling of the pivotal element is carried out by a large wrap spring positioned on a shaft at the rear of the winder.

Although this winder has been found to work well, there are a number of drawbacks. First, the elements are biased toward one another, which requires a relatively large force to open the elements to establish the strap path. Second this arrangement uses a complex cam and plate system to properly "time" the winder operating modes, e.g., the feed and retraction operating modes and to maintain the strap slot open. It has been found that the complexity of the winder, in conjunction with the large wrap spring can require more maintenance than practicable given the operational requirements of the strapping machines, generally.

Accordingly, there exists a need for a winder for a strapping machine that uses the tension in the strapping material to maintain the winder closed (i.e., to secure the strap in the winder). Desirably, in such a winder, the winder nevertheless begins to close, effectively tensioning the strap, before the strap winds over itself, without the need for a high rate spring. Desirably, such a winder is effective over a range of strap gauges and can be used with highly compressible loads. More desirably, such a winder can also provide a high tension in the rewound strap.

BRIEF SUMMARY OF THE INVENTION

A winder for use in a strapping machine of the type for positioning a strap material around an associated load and tensioning the strap material around the load includes a frame for supporting the load, a chute positioned on the frame for receiving the strap material and orienting the strap material around the load, a strap supply and a strapping head for extracting the strap from the supply, feeding the strap through the chute around the load, passing the strap from the chute around the load, retracting and tensioning the strap.

The winder is positioned at the strapping head. Briefly, the strapping head includes a single pair of rollers for both feeding and retracting the strap, and a winder for tensioning the strap around the load. The strapping machine also includes a weld head for welding the overlapping strap sections to one another. In a present arrangement, the strapping head and weld head are separate units.

In one embodiment, the winder includes a rotating head portion having a stationary element and a pivotal element. The stationary and pivotal elements each define an outer surface around which the strap material is wound and also define a slot therebetween for receiving the strap material. The elements each include a gripping portion at about respective ends opposingly facing one another.

The pivotal element is pivotal between an open position in which the gripping portions are spaced from one another and a closed position in which the gripping portions cooperate with one another to engage and secure the strap material therebetween. Preferably, the pivotal element is biased to the open position.

The winder includes a pivot assist assembly to assist moving the pivotal element gripper toward the stationary element gripper to enhance securing the strap between the grippers. In a present embodiment, the pivot assist assembly includes a pin extending from the pivotal element and a track portion stationary relative to the rotating head portion. The track has a generally circular shape and is configured for the pin to traverse around the track. The track has a first portion having a first diameter and a second diameter less than the first diameter. The differences in relative diameters can be at the outer diameters.

The winder rotates from a home position in which the pin is in the first portion of the track and the winder is in the open position to an other than home position in which the pin is in the second portion of the track such that the pin engages a wall of the track at the second diameter urging the winder toward the closed position.

In one embodiment of the winder, the pivot member is positioned at about an inlet of the winder, at a location upstream of the pivotal element gripping portion. In this embodiment, the pivot member is disposed at about the outer surface, e.g., at about a periphery, of the pivotal element. Alternately, the pivot member can be disposed intermediate the pivotal element gripping portion and a strap exit of the winder.

Preferably, the pivotal element gripping portion is mounted in the element for pivoting movement independent of the movement of the pivotal element. This permits a gripper pad to lie on the strap and conform to the strap path as it traverses through the winder.

A current winder includes an over-rotation plate to permit rotation of the winder in excess of 360 degrees. The plate is positioned between the winder and the strapping head frame.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
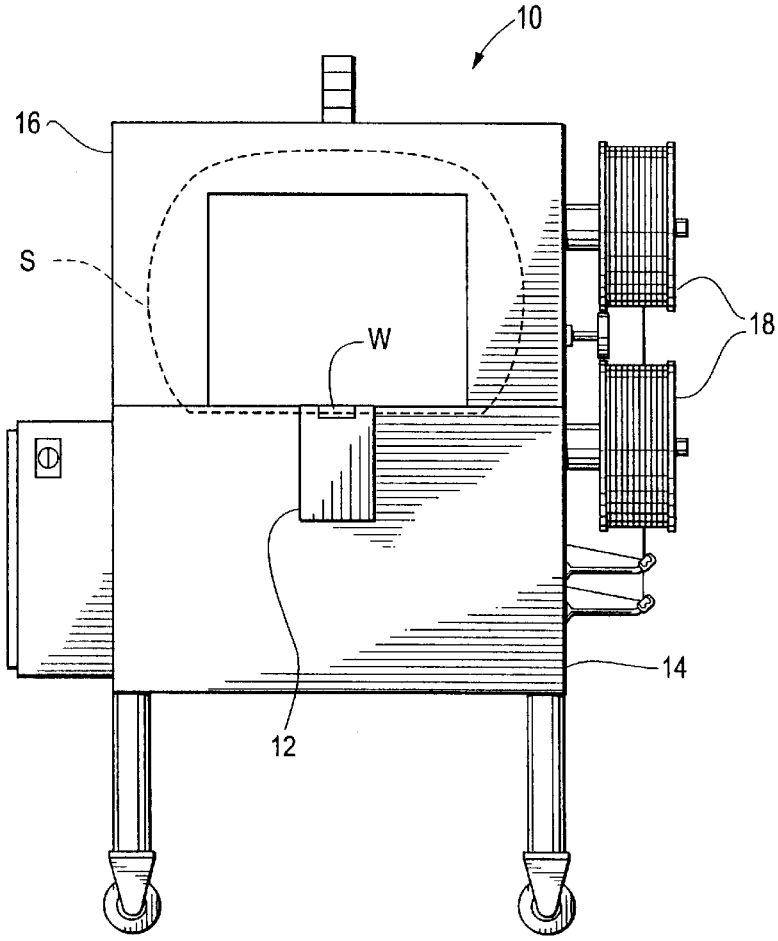
FIG. 1 is front view of an exemplary strapping machine illustrating, generally the components and arrangement thereof, the machine shown with a strapping head embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular, to FIG. 1, there is shown a strapping machine 10 having a strapping head 12 embodying the principles of the present invention. The strapping machine 10 includes generally a frame 14 supporting a strap chute 16 around which the strap S is advanced during the strapping operation. One or more strap dispensers 18 supply strap material S to the strapping head 12. The overall arrangement and operation of such a strapping machine is disclosed in U.S. Pat. Nos. 4,605,456 and 5,299,407, which patents are incorporated herein by reference.

Figure 2:
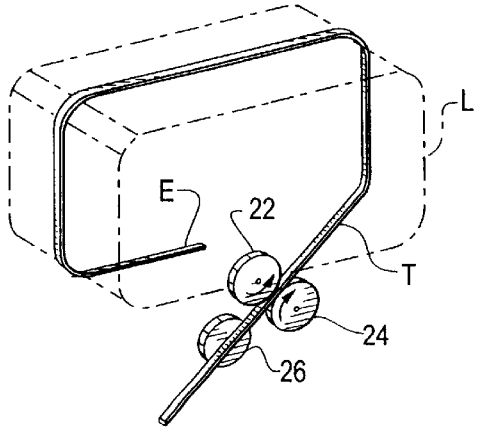
FIG. 2 is a schematic illustration of the strapping machine showing the relative position of a load of items to be strapped, and one exemplary relative position of the strapping head on the machine.

The strapping head 12 is that portion of the machine 10 that withdraws or pulls the strap S from the dispenser 18, feeds the strap S through the chute 16, grasps the leading edge E of the strap S so as to bring it into contact with a trailing portion T, and tensions the trailing portion T so as to compress the load L. In the illustrated embodiment, the strapping machine 10 includes a separate welding head (shown schematically at W) for sealing the overlapping strap portions E, T to one another to effect a seal, a schematic illustration of which is shown in FIG. 2. A cutter (not shown) severs the strap S at the supply end (i.e., the trailing end E) to free the strapped load L.

Figure 3:
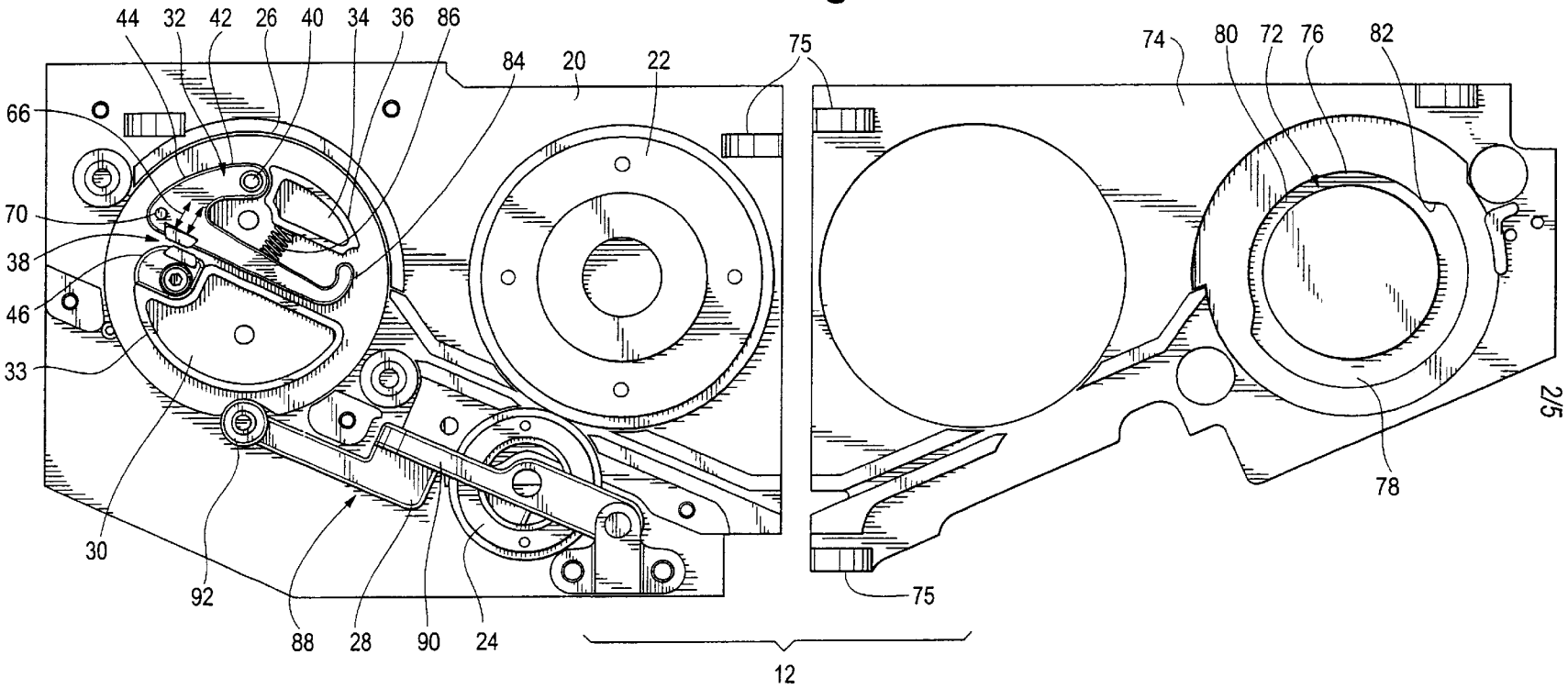
FIG. 3 is a partial view of the strapping head, showing the cover pivoted and removed from the strapping head frame for clarity of illustration, the head being illustrated in the feed position, and further shown without strap material positioned therein.

As illustrated in FIG. 3, the strapping head includes a frame 20, a plurality of rollers 22, 24 and a winder 26. The rollers 22, 24 serve to both feed strap S through the chute 16 around the load L, and to retract or rewind (wind) the strap S to tension the strap S around the load L. In the illustrated embodiment, the rollers 22, 24 include a driven roller 22 and an idler roller 24 that rotates only in frictional cooperation with the driven roller 22.

The rollers 22, 24 are operably connected to a drive (not shown), such as a belt drive or a direct drive to provide rotational movement to the driven roller 22. In a current embodiment, the drive is also configured for driving the winder 26 and is operably connected to the winder 26 by clutch (not shown). Such a drive arrangement will be understood and appreciated by those skilled in the art and is within the scope and spirit of the present invention.

As illustrated, the idler roller 24 is mounted to a pivoting bracket or link 28 for moving the idler roller 24 into and out of engagement with the driven roller 22. As will be described in more detail below, when the strapping machine 10 is operating in a rewind or tensioning mode, the idler roller 24 is cammed out of contact with the driven roller 22 to permit rewinding the strap S.

The winder 26 is a biased rotating element having a stationary element 30 and a pivotal element 32, that define a generally circular outer peripheral profile 33. A second stationary element 34 can be positioned circumferentially along the path of the pivotal element 32 to more completely define the circular profile 33. The second stationary element 34 is formed having an arcuate outer surface 36 continuing the circular profile. A strap path, indicated generally at 38, is defined by and between the stationary and pivotal elements 30, 32.

In one embodiment, the pivotal element 32 pivots about a pivot pin 40 that is positioned along the periphery 42 of the arcuate portion 44 of the element 32, upstream of the strap path entrance, as indicated by the arrow at 46. For purposes of the present discussion, the downstream direction is that direction that the strap travels in the feed operation, i.e., toward the items to be strapped, as indicated by the arrow at 48 in FIG. 4, and upstream is that direction toward the strap supply, as indicated by the arrow at 50.

Figure 4:
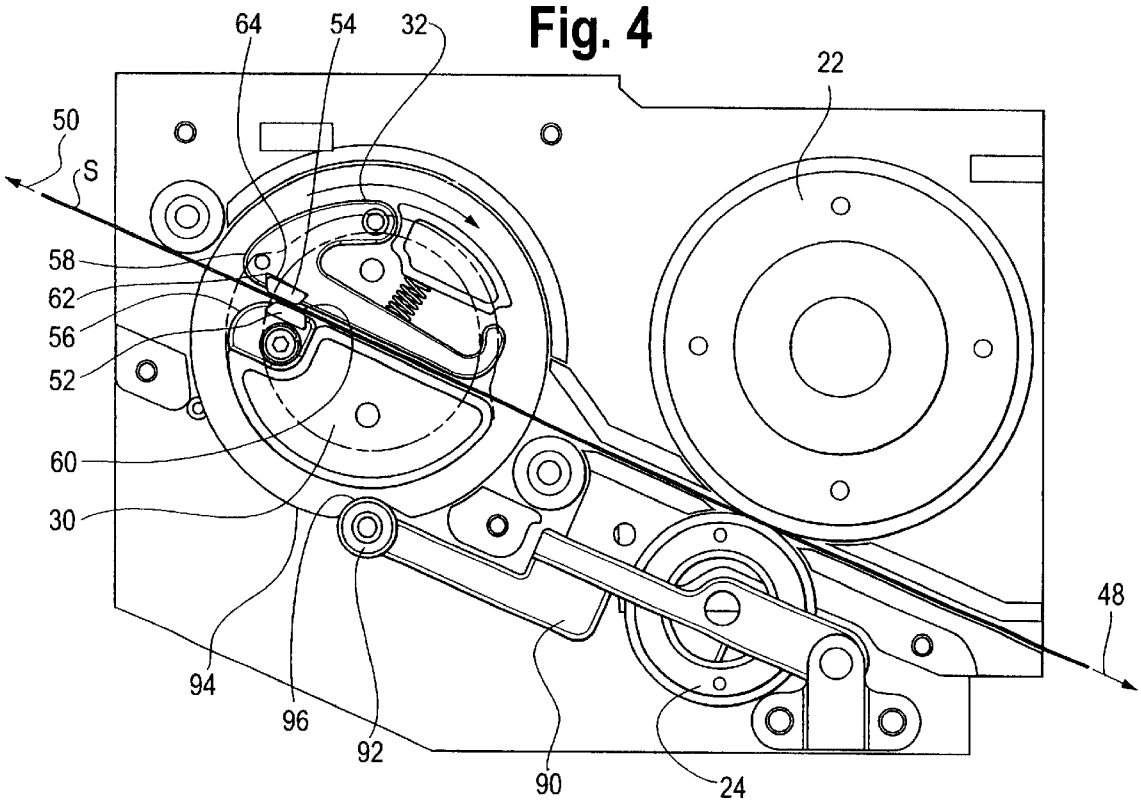
FIG. 4 is a front view of the strapping head of FIG. 3 shown with the strap material traversing through the head, including the winder, the strapping head being shown in feed mode, and further showing the cam track formed in the cover in phantom lines overlying the winder.

Referring briefly to FIG. 4, both the stationary and pivotal elements 30, 32 include gripping members 52, 54 at their respective upstream ends 56, 58. The grippers 52, 54 provide frictional surfaces for securing the strap S to prevent slippage as the winder 26 begins to rotate. In a present embodiment, the gripping elements 52, 54 are hardened steel pads each having a ridged or corrugated surface 60 to enhance the gripping tendency of the pad 52, 54. In a present embodiment, the pads 52, 54 are replaceable. As seen in FIG. 3, the pivotal element gripper 54 resides in a slot or channel 62 in the element 32 that is slightly larger than the gripper pad 54 and is formed having a peaked surface, indicated at 64, rather than flat base surface. This mounting configuration permits the gripping element 54 to rock back and forth as indicated by the arrows at 66 (see FIG. 3) to conform the angle of the pad 54 surface to the angle at which the strap S lies on the pad 54. This provides maximum surface contact area between the strap S and the gripper pad 54 surface.

As will be appreciated from a study of the figures, as the winder 26 begins to rotate from the open strap path 38 position (FIGS. 3 and 4) to the closed path 38 position (FIGS. 5–7), the urging of the strap S against the pivotal element 32 moves the pivotal element gripper 54 toward the stationary element gripper 52. Continued rotation of the winder 26 results in an increased force exerted by the strap S on the pivotal element 32 which, in turn, results in an increased "gripping" force on the strap S. This, of course, prevents the strap S from slipping between the elements 30, 32, and thus permits an increase in the ability to apply a tension (e.g., apply a higher tension) in the rewound strap S. As the winder 26 continues to rotate, the force exerted by the grippers 52, 54 on the strap S increases. And, if the winder 26 rotates to the extent that the strap S winds onto itself (i.e., greater than about 180 degrees of rotation), the force of the strap S winding onto itself maintains the strap S in place, without slippage.

Ultimately, the increased tension that is induced by the winder 26 results in an increase in the tension in the strap S around the items L. In that much of the tension can be induced in the strap S in a relatively small rotation of the winder 26, it is desirable to assure that there is little to no slip of the strap S as the winder 26 commences rotation. The pivotal nature of the present winder 26 facilitates an "early" grip on the strap S. However, as seen in FIG. 4, at the start of rotation, the force exerted by the strap S on the pivotal element 32 may be minimal, thus it may not provide the necessary force on the grippers 52, 54 to secure the strap S without slippage.

To assist urging the pivotal element 32 (and thus the pivotal element gripper 54) into contact with the stationary element gripper 52, the present winder 26 includes a pivot assist assembly 68. In a present embodiment, the pivot assist assembly 68 includes a camming arrangement that further pivots the pivotal element 32 toward the stationary element 30.

Referring to FIGS. 3 and 4, the exemplary pivot assist assembly 68 includes a pin 70 extending from the winder pivotal element 32, at about the upstream end 58, upstream of the gripper 54. The pin 70 is configured to cooperate with a cam track 72 formed in a cover 74 of the strapping head 12. The cover 74, as best seen in FIG. 3, is configured to overlie the strapping head 12 to, among other things, protect the strapping head 12 from debris or interference during operation, and to protect personnel by prevent access to the moving parts of the strapping head 12 during operation. In a current embodiment, the cover 74 is mounted to the frame 20 by hinges 75. The cam track 72 is formed in the cover 74 at that portion of the cover 74 that overlies the winder 26. The cam track 72 is formed as a circular channel or groove 76 having a first portion 78 having a wide track width and a second portion 80 having a narrow track width. The first and second portions 78, 80 are contiguous with one another.

Figure 5:
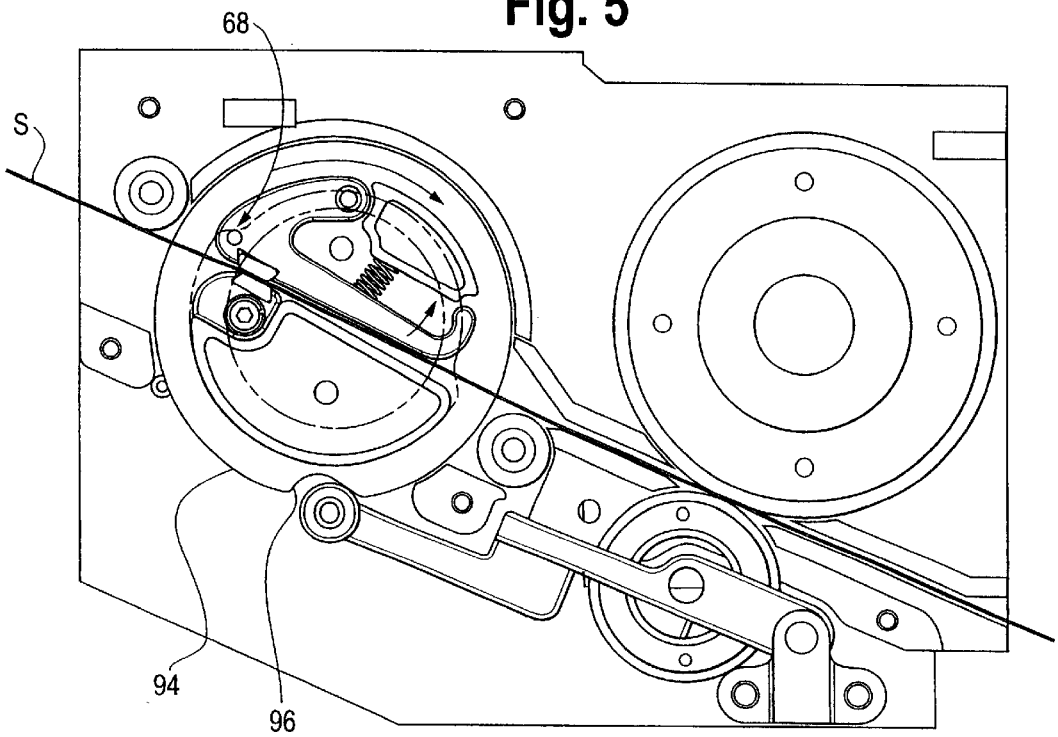
FIG. 5 is a front view similar to FIG. 3 showing the strapping head in rewind mode with the winder commencing rotation.

Referring now to FIG. 4, the winder 26 is shown with the cover 74 removed, but with the cam track 72 shown in dashed or phantom lines. In this figure, the strapping head 12 is in or near the feed mode (that is, with the winder 26 positioned so that the strap path 38 is straight-through), with the pin 70 lying in the wide track width portion 78. In this position, the pivotal element 32 is "free" to move with the strap S. As the winder 26 commences rotation, as seen in FIG. 5, the pin 70 moves into narrow track width portion 80. In this track portion, the pin 70 contacts an outer wall 82 of the narrow track 80 and is urged inward. This, in turn, pivots the pivotal 32 element toward the closed position (that position in which the pivotal element gripper 54 is urged toward and into contact with the stationary element gripper 52), thus increasing the gripping force on the strap S. This prevents the strap S from slipping through the winder 26.

Figure 6:
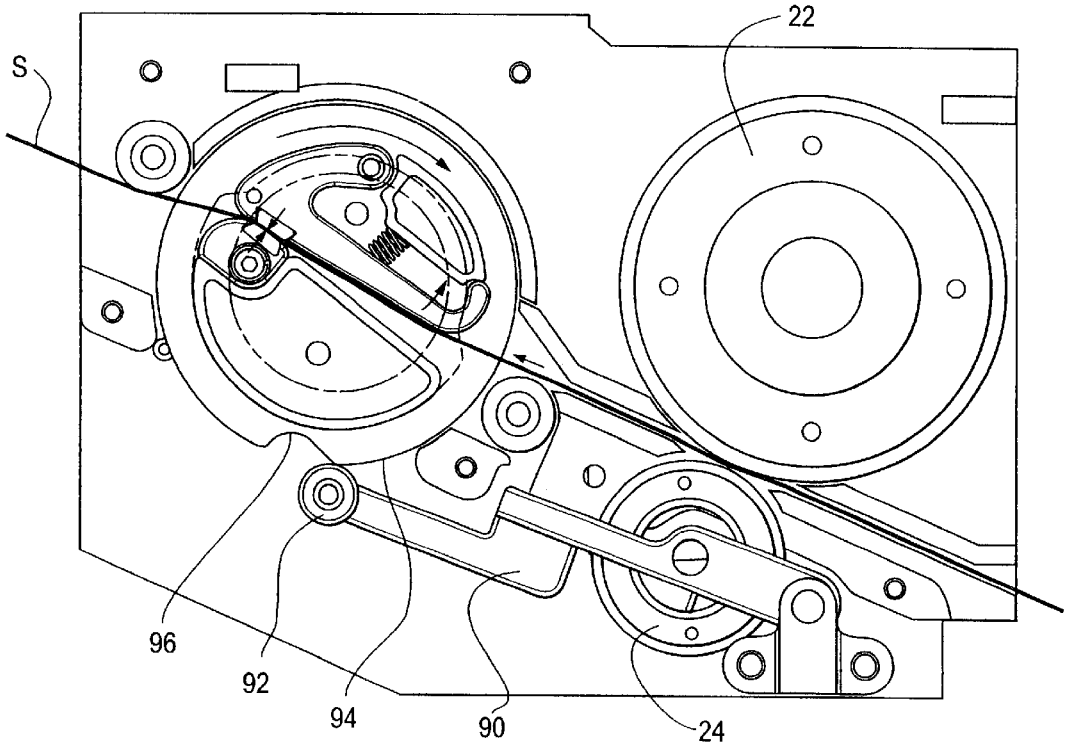
FIG. 6 is a further front view of the strapping head showing further rotation of the winder.
Figure 7:
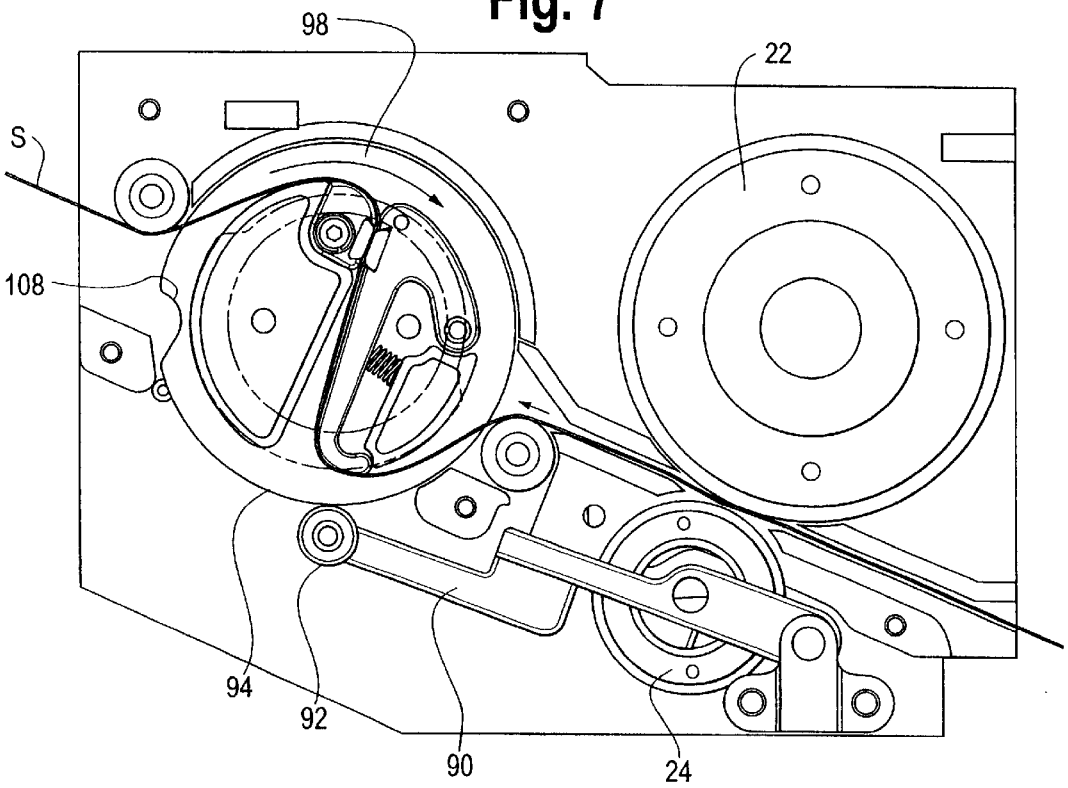
FIG. 7 is a still further front view of the winder showing yet further rotation of the winder.

As seen now in FIGS. 5–7, the assistance (i.e., increased pressure) provided by the pivot assist assembly 68 continues through about 180 degrees of travel of the winder 26. At this point, the strap S will have wound about itself, and this winding, along with the pressure exerted by the strap S to pivot the pivotal element 32 is sufficient to maintain the strap S in the winder 26 without slipping. As such, the track transitions back to the wide track portion 78 after slightly over 180 degrees.

The pivotal element 32 further includes, at the downstream end, a curved surface 84. This surface 84 facilitates a smooth transition for winding the strap S around the stationary and pivotal elements' 30, 32 outer circumferential surfaces 33 when the winder 26 is actuated.

Referring again to FIG. 4, to maintain the pivotal element 32 in the open position during feeding operation, the pivotal element 32 is biased toward the open position. A biasing element 86, such as the illustrated coil spring is positioned between the pivotal element 32 and the second stationary element 34 to effect this biased orientation.

As set forth above, when the strapping machine 10 commences rewind mode, it is necessary to disengage the rollers 22, 24 so that the strap S material can be "pulled" rearward, through the rollers 22, 24 toward the strap supply, e.g., toward the dispensers 18. To effect disengagement, a feed cam assembly 88 operably connects the winder 26 to the rollers 22, 24. In a present embodiment, the driven roller 22 is fixedly mounted to the strapping head frame 20 and the idler roller 24 is mounted to the frame 20 by a pivoting arm or link 90.

The arm 90 is configured to move the idler roller 24 toward and away from the driven roller 22 between an engaged position and a disengaged position. As the position labels provide, in the engaged position (FIG. 4), the idler roller 24 engages the driven roller 22 to feed strap S through the strapping head 12, and in the disengaged position (FIGS. 5–7), the idler roller 24 is spaced, that is, pulled away from the driven roller 22 so that the strap S is able to be moved freely between the rollers 22, 24. The pivoting arm 90 is biased toward the engaged position, and must be urged to the disengaged position.

The pivoting arm 90 includes a cam roller 92 on an end thereof. The cam roller 92 rides along an outer periphery on a flange 94 of the winder 26. The flange 94 includes a recess 96 in which the cam roller 92 sits when the strapping machine 10 (the strapping head 12) is in feed mode. The cam roller 92 residing in the recess 96 permits the idler roller 24 to engage the driven roller 22.

As the winder 26 commences rotation, the cam roller 92 is urged out of the recess 96 to ride along the outer periphery or flange 94. This pivots the arm 90, in turn, urging the idler roller 24 away from the driven roller 22, and moving the rollers 22, 24 to the disengaged position. In this manner, the winder 26 cooperates with the rollers 22, 24 in a directly linked relationship to assure that the rollers 22, 24 are disengaged from the strap S during rewind mode.

It is recognized that certain items may be highly compressible. For example, bales of cotton or other loosely pack or soft items may require that a considerable amount of strap S be rewound in order to achieve a desired tension in the strap S (or compression in the bundled material L). In such cases, it may be necessary for the winder 26 to rotate to or over about 360 degrees. In such instances, it is necessary to assure that the cam roller 92 does not set back into the winder recess 96 to reengage the driven and idler rollers 22, 24.

Figure 8:
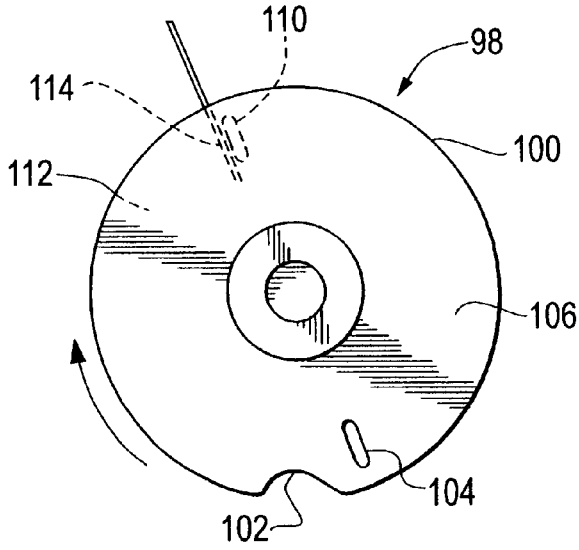
FIG. 8 is a front view of the over-rotation plate that is positioned between the winder and the strapping head frame.

Referring to FIG. 8, to prevent reengagement of the driven and idler rollers 22, 24 when rewinding over 360 degrees, the strapping head 12 includes an over-rotation plate 98. The plate 98 is mounted between the winder 26 and the head frame 20. The plate 98 is configured with an outer periphery 100 that is the same diameter as the winder flange 94. The plate 98 is configured so that as the winder 26 rotates, the plate outer periphery 100 will "fill-in" as the flange recess 96 passes by the cam roller 92.

As seen in FIG. 8, the over-rotation plate 98 includes a recess 102 that is similar to the recess 96 in the winder flange 94 so that when the winder 26 and plate 98 are aligned with one another (i.e., during feed mode), the cam roller 92 rests in both recesses 96, 102 to permit engagement of the idler roller 24 with the driven roller 22.

A projection 104 extends upwardly from a front face 106 of the over-rotation plate 98, adjacent and behind the recess 102. The projection 106 is configured to engage a stop (for example, see 108 in FIG. 7) on the winder 26, forward of the winder recess 96, after the winder 26 has rotated, and as the recess 96 approaches the cam roller 92. When the projection 106 engages or contacts the stop 108, it rotates the plate 98 to prevent alignment of the recesses 96, 102, and to assure that the plate periphery 100 passes over the winder recess 96 before the winder recess 96 passes by the cam roller 92. In this manner, the pivot arm 90 remains cammed outward when the winder recess passes the cam roller 92 during rewinding which in turn maintains the idler roller 24 disengaged from the driven roller 22. As will be appreciated by those skilled in the art, the over-rotation plate 98 is configured to permit an additional rotation of the winder 26 to achieve almost an additional 360 degrees.

To prevent the over-rotation plate 98 from continuing to rotate (e.g., over rotating), a projection 110 extends from a rear surface 112 of the plate 98, that is configured to engage a stop 114 on the head frame 20. The plate rear surface projection 110 and the frame stop 114 can be configured to permit up to almost an additional 360 degree rotation, for a total rotation of almost 720 degrees. The rear surface projection 110 and frame stop 114 also assure that after completion of the rewind mode, the over-rotation plate 98 returns so that the winder and plate recesses 96, 102, are aligned at the cam roller 92 for proper feeding operation.

Figure 9:
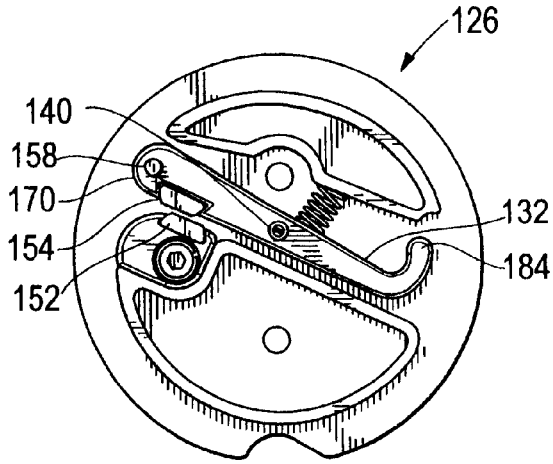
FIG. 9 is a front view of an alternate embodiment of the winder having mid-pivot pivotal element.

An alternate embodiment of the winder 126 is illustrated in FIG. 9. In this embodiment, the pivot pin 140, rather than positioned at a periphery of the pivotal portion 132, is disposed at about a midpoint (relative to the upstream-downstream direction) of the pivot portion 132. In this embodiment, the pivot assist assembly pin 170 remains extending from the winder pivotal element 132, at about the upstream end 158, upstream of the gripper 154.

The downstream end of the pivotal element 184 can be configured having an exaggerated curved portion as illustrated or it can be relatively straight, with a rounded end (not shown), again to facilitate smooth winding of strap S on, and movement of strap S across, the winder 126. In this embodiment, the pivotal element gripper 154 moves toward the stationary element gripper 152 in a generally straight line path, rather than inward and toward the downstream direction as it moves toward the stationary gripper element 152.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A winder for a strapping machine that positions a strap material around a load and tensions the strap material around the load, the winder comprising:

a rotating head portion having a stationary element and a pivotal element, the stationary and pivotal elements each defining an outer surface around which the strap material is wound and defining a slot therebetween for receiving the strap material, the stationary and pivotal elements each defining a gripping portion at about respective ends opposingly facing one another, the pivotal element being pivotal between an open position in which the gripping portions are spaced from one another and a closed position in which the gripping portions cooperate with one another to engage and secure the strap material therebetween, the pivotal element being biased to the open position, the pivotal element including a pin extending therefrom; and a track portion stationary relative to the rotating head portion, the track having a generally circular shape and configured for the pin to traverse around the track, the track having a first portion having a first diameter and a second diameter less than the first diameter, wherein the winder rotates from a home position in which the pin is in the first portion of the track and the winder is in the open position to an other than home position in which the pin is in the second portion of the track such that the pin engages a wall of the track at the second diameter urging the winder toward the closed position.

2. The winder in accordance with claim 1 wherein the pivotal element is pivotal about a pivot member.

3. The winder in accordance with claim 2 wherein the pivot member is positioned at about an inlet of the winder, at a location upstream of the pivotal element gripping portion.

4. The winder in accordance with claim 3 wherein pivot member is disposed at about the outer surface of the pivotal element.

5. The winder in accordance with claim 2 wherein the pivot member is disposed intermediate the gripping portions and a strap exit of the winder.

6. The winder in accordance with claim 1 wherein the pivotal element gripping portion is mounted therein for pivoting movement independent of the pivotal movement of the pivotal element.

7. The winder in accordance with claim 1 including an over-rotation plate to permit rotation of the winder in excess of 360 degrees.

8. The winder in accordance with claim 1 wherein the pivotal element is biased to the open position.

9. A strapping machine for positioning a strap material around an associated load and tensioning the strap material around the load, comprising:

a frame for supporting the load;

a chute positioned on the frame for receiving the strap material and orienting the strap material around the load;

a strap supply; and a strapping head for extracting the strap from the supply, feeding the strap through the chute around the load, passing the strap from the chute around the load, retracting and tensioning the strap, the strapping head including a frame, a pair of rollers mounted to the frame for feeding and retracting the strap and a winder for providing a tension in the strap, the winder including a rotating head portion mounted to the frame having a stationary element and a pivotal element, the stationary and pivotal elements each defining an outer surface around which the strap material is wound and defining a slot therebetween for receiving the strap material, the stationary and pivotal elements each defining a gripping portion at about respective ends opposingly facing one another, the pivotal element being pivotal between an open position in which the gripping portions are spaced from one another and a closed position in which the gripping portions cooperate with one another to engage and secure the strap material therebetween, the pivotal element including a pin extending therefrom, and a track portion stationary relative to the rotating head portion, the track having a generally circular shape and configured for the pin to traverse around the track, the track having a first portion having a first diameter and a second diameter less than the first diameter, wherein the winder rotates from a home position in which the pin is in the first portion of the track and the winder is in the open position to an other than home position in which the pin is in the second portion of the track such that the pin engages a wall of the track at the second diameter urging the winder toward the closed position.

10. The strapping machine in accordance with claim 9 including an over-rotation plate mounted between the winder and the frame for rotating the winder in excess of 360 degrees.

11. The strapping machine in accordance with claim 9 wherein the pivotal element is pivotal about a pivot member.

12. The strapping machine in accordance with claim 11 wherein the pivot member is positioned at about an inlet of the winder, at a location upstream of the pivotal element gripping portion.

13. The strapping machine in accordance with claim 12 wherein pivot member is disposed at about the outer surface of the pivotal element.

14. The strapping machine in accordance with claim 11 wherein the pivot member is disposed intermediate the gripping portions and a strap exit of the winder.

15. The strapping machine in accordance with claim 9 wherein the pivotal element gripping portion is mounted therein for pivoting movement independent of the pivotal movement of the pivotal element.

16. The strapping machine in accordance with claim 9, wherein the pivotal element is biased to the open position.

17. A strapping head for use in a strapping machine for positioning a strap material around an associated load and tensioning the strap material around the load, the strapping head comprising:

a single set of rollers for feeding the strap material around the load and for retracting slack strap material;

a winder for rewinding the strap material to tension the strap material around the load, the winder including a rotating head portion having a stationary element and a pivotal element, the stationary and pivotal elements each defining an outer surface around which the strap material is wound and defining a slot therebetween for receiving the strap material, the stationary and pivotal elements each defining a gripping portion at about respective ends opposingly facing one another, the pivotal element being pivotal between an open position in which the gripping portions are spaced from one another and a closed position in which the gripping portions cooperate with one another to engage and secure the strap material therebetween, the pivotal element being biased to the open position, the winder including a pivot assist assembly for engaging the pivotal element and urging the pivotal element toward the stationary element as the winder rotates from a home position in which the winder is in the open position and an other then home position in which the winder is in the closed position, the pivot assist assembly having a first portion that rotates with the rotating head cooperating with a second portion that is stationary relative to the rotating head.

18. The strapping head in accordance with claim 17 wherein the pivot assist assembly includes a pin and track portion cooperating with one another.

19. The strapping head in accordance with claim 18 wherein the pin is disposed on the pivotal element and the track is formed in a cover portion for the strapping head.

20. The strapping head in accordance with claim 18 wherein pivotal element is biased to the open position.

21. The strapping head in accordance with claim 19 including a frame, wherein the cover is hingedly mounted to the frame overlying the winder.

22. A winder for a strapping machine that positions a strap material around a load and tensions the strap material around the load, the winder comprising:

a rotating head portion having a stationary element and a pivotal element, the stationary and pivotal elements each defining an outer surface around which the strap material is wound and defining a slot therebetween for receiving the strap material, the stationary and pivotal elements each defining a gripping portion at about respective ends opposingly facing one another, the pivotal element being pivotal between an open position in which the gripping portions are spaced from one another and a closed position in which the gripping portions cooperate with one another to engage and secure the strap material therebetween, the pivotal element being biased to the open position, the pivotal element including a pin extending therefrom; and a pivot assist assembly for engaging the pivotal element and urging the pivotal element toward the stationary element as the winder rotates from a home position in which the winder is in the open position and an other then home position in which the winder is in the closed position.

23. The winder in accordance with claim 22 wherein the pivot assist assembly includes a pin and track portion cooperating with one another.

24. The winder in accordance with claim 23 wherein the pin is disposed on the pivotal element and the track is formed in a cover portion for the strapping head, the cover portion being stationary relative to the rotating head portion.

25. The winder in accordance with claim 22 wherein the pivotal element is biased to the open position.

26. The winder in accordance with claim 24 wherein the track has a generally circular shape and is configured for the pin to traverse around the track, the track having a first portion having a first outer diameter and a second diameter less than the first diameter and wherein the winder rotates from a home position in which the pin is in the first portion of the track and the winder is in the open position to an other than home position in which the pin is in the second portion of the track such that the pin engages a wall of the track at the second diameter urging the winder toward the closed position.

* * * * *